US006510563B1

(12) United States Patent
Jarosinski et al.

(10) Patent No.: US 6,510,563 B1
(45) Date of Patent: Jan. 28, 2003

(54) FLUSH VALVE ADAPTER FOR CONVERTING A SINGLE FLUSH VALVE SYSTEM TO A DUAL FLUSH VALVE SYSTEM

(76) Inventors: Louis Jarosinski, 2528 Woodlark Dr., Fort Worth, TX (US) 76123; Jane Summers, 2528 Woodlark Dr., Fort Worth, TX (US) 76123

( * ) Notice: Subject to any disclaimer, the term of this patent is extended or adjusted under 35 U.S.C. 154(b) by 0 days.

(21) Appl. No.: 09/907,417

(22) Filed: Jul. 17, 2001

(51) Int. Cl.[7] ..... E03D 1/14; E03D 3/12
(52) U.S. Cl. ..... 4/326; 4/324; 4/325; 4/405
(58) Field of Search ..... 4/324–327, 249, 4/405, 411–415

(56) References Cited

U.S. PATENT DOCUMENTS

| | | | | |
|---|---|---|---|---|
| 1,474,288 A | | 11/1923 | Rath | |
| 1,767,043 A | * | 6/1930 | Blaun et al. | 4/326 |
| 3,795,016 A | | 3/1974 | Eastman | |
| 4,042,982 A | | 8/1977 | Contreras | |
| 4,175,295 A | | 11/1979 | Cameron | |
| 4,829,605 A | * | 5/1989 | Agostino | 4/326 |
| 5,881,399 A | * | 3/1999 | Kartoleksono et al. | 4/324 |
| 6,178,567 B1 | | 1/2001 | Bliss | |

* cited by examiner

*Primary Examiner*—Gregory L. Huson
*Assistant Examiner*—Tuan Nguyen
(74) *Attorney, Agent, or Firm*—Andrus, Sceales, Starke & Sawall

(57) ABSTRACT

An adapter for attachment to an existing single flush valve system to convert the single valve system to a dual flush valve system comprises a pair of tubular sections vertically offset from one another and connected by a hollow, enclosed channel. The upper section is adapted to engage a discharge pipe of an existing single flush valve system in order to select a discharge level for a lower volume flush and direct water flowing through the discharge pipe through the adapter. The bottom section of the adapter includes a pivotable flapper valve that can be operated independently of the flapper valve disposed on the single flush system in order to provide a greater volume of water for flushing of the toilet. A mounting arrangement is also provided for attachment to the toilet tank which enables the existing and additional flapper valves to be selectively activated using a pair of handles connected to the arrangement.

3 Claims, 4 Drawing Sheets

FIG. 1
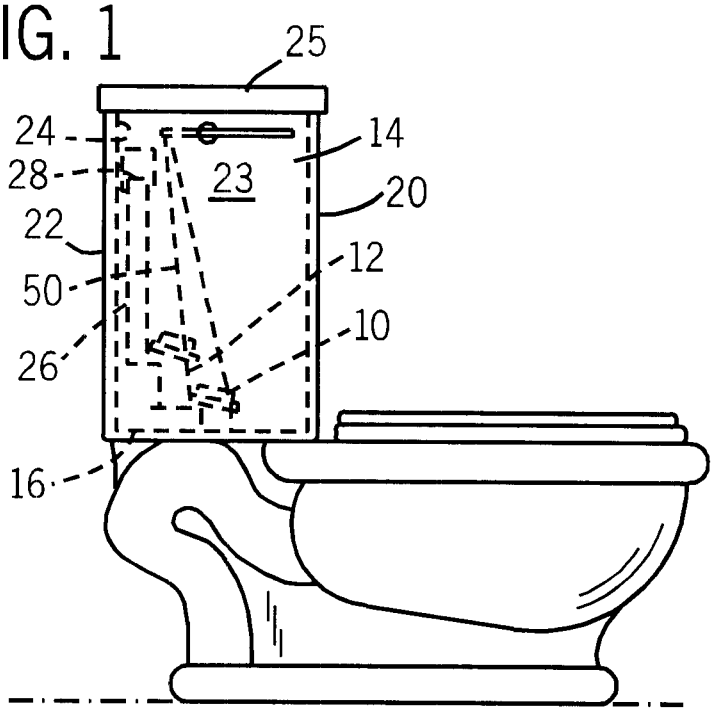
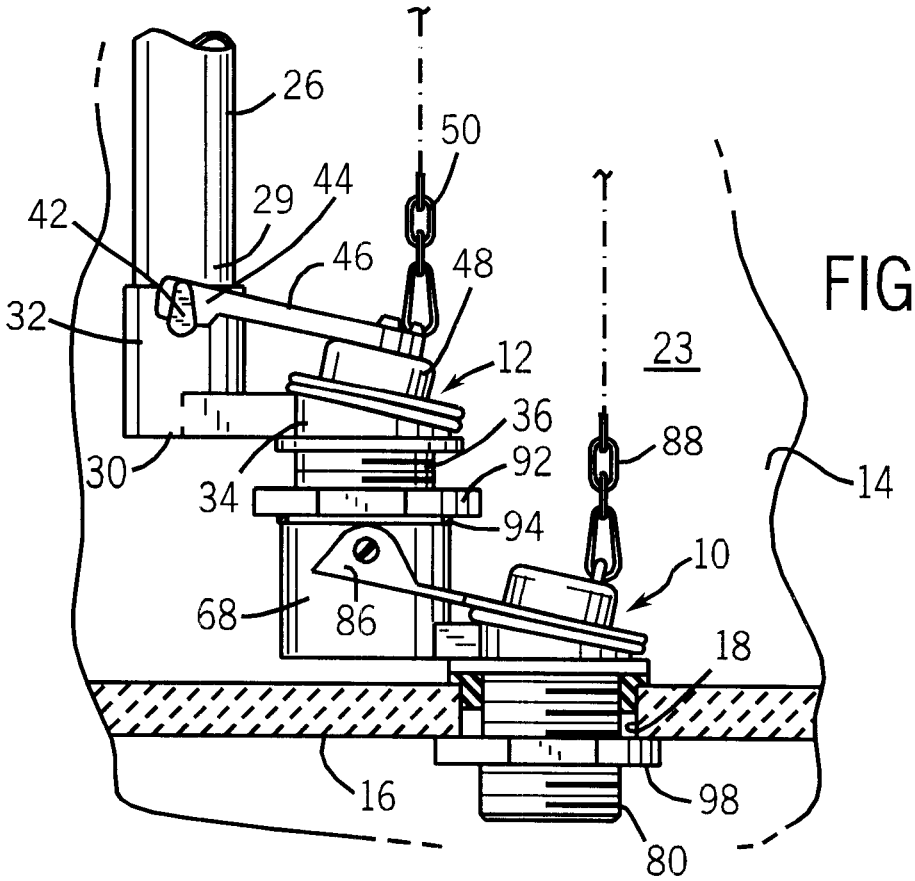
FIG. 2

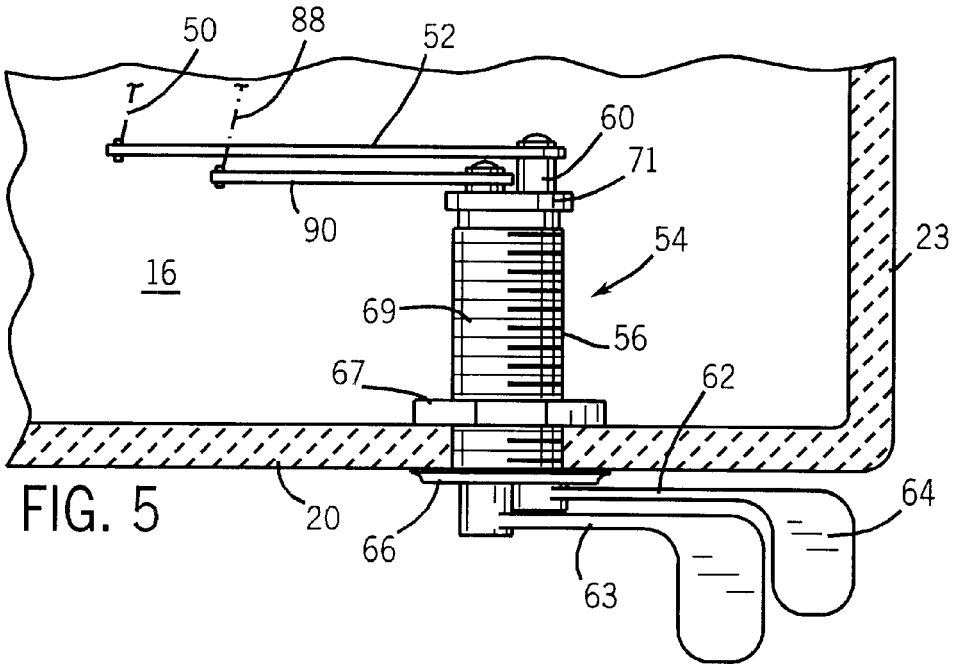
FIG. 5
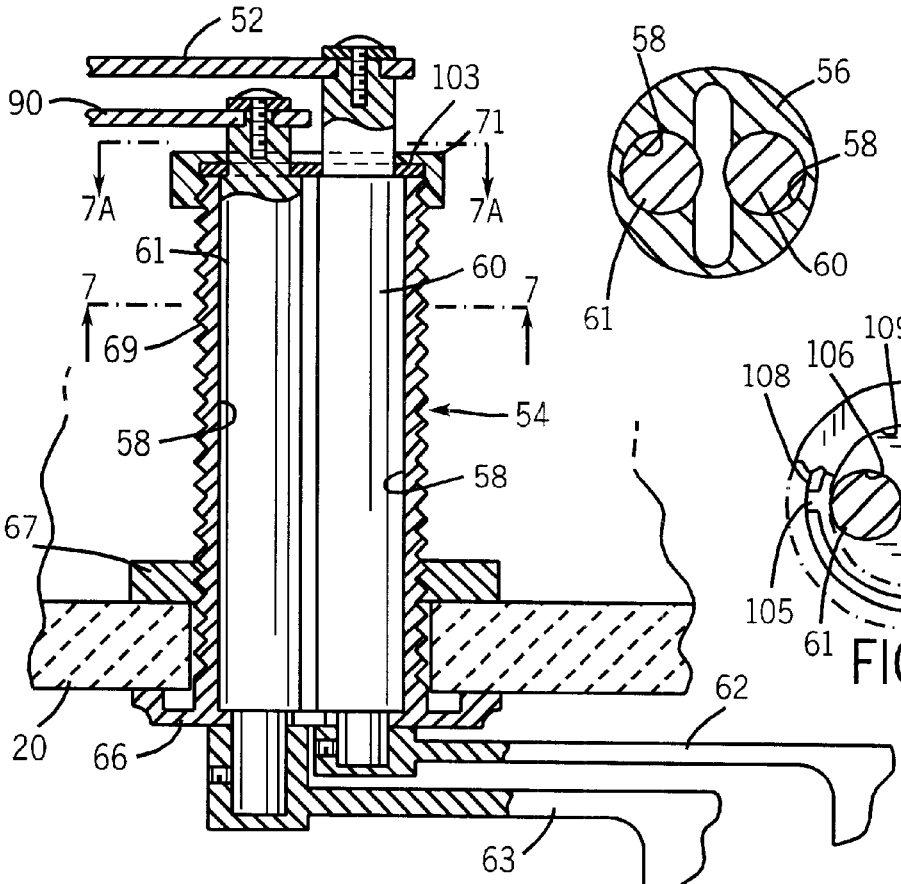
FIG. 6
FIG. 7
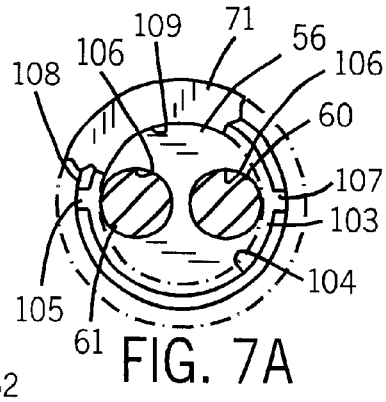
FIG. 7A

FLUSH VALVE ADAPTER FOR CONVERTING A SINGLE FLUSH VALVE SYSTEM TO A DUAL FLUSH VALVE SYSTEM

BACKGROUND OF THE INVENTION

The present invention relates to a flush valve for toilets, and more specifically to a converter or adapter for changing a single flush valve into a dual flush valve.

In order to prevent the unnecessary of use of water when flushing a toilet, a number of different dual valve systems have been designed which enable the toilet to be flushed using either a large amount or a reduced amount of water as desired.

An early example of a dual valve system of this type is disclosed in Rath U.S. Pat. No. 1,474,288. In this construction, a pair of flapper valves are positioned at different heights on a unitary tubular valve housing. Each valve is independently operated and enables an individual to utilize either a large amount or a reduced amount of water when flushing the toilet.

Other examples of dual valve systems are disclosed in Eastman U.S. Pat. No. 3,795,016; Contreras U.S. Pat. No. 4,042,982; Cameron U.S. Pat. No. 4,175,295 and Bliss U.S. Pat. No. 6,178,567B1. In each of these patents, a pair of flapper valves are disposed at different heights on a valve housing. Each of the flapper valves is connected to a pivotable handle by a chain extending from the valve to an attachment point on the handle or to a lever extending from the handle. In order to control the volume of water utilized when flushing the toilet, the handle is rotated in a first direction to open the higher flapper valve to provide the desired amount of water. To open the lower flapper valve, the handle is either rotated in the opposite direction or rotated further in the first direction to open the lower valve and use an increased amount of water when flushing the toilet.

While each of the above-referenced patents illustrates a useful manner of controlling the amount of water utilized when flushing a toilet, in each of the above patents, the dual valve system is comprised of a single structure on which the pair of flapper valves are disposed. As a result, when incorporating one of these dual valve systems into an existing toilet, the single valve system already present within the toilet must be completely removed in order to insert the particular dual valve system. The single valve system is then discarded, resulting in a significant waste of material and money. Furthermore, should the valve housing for the dual valve system ever become damaged, the entire valve housing must be removed and replaced which increases the expense of utilizing a dual mode valve system, reducing the benefit obtained by the reduction in water consumption.

Therefore, it is desirable to develop a converter or adapter for a conventional single valve flush system capable of converting the single valve system into a dual valve flush system. Such a converter should be easily attachable to the flush tank for the toilet and to the existing single valve system.

SUMMARY OF THE INVENTION

It is an object of the invention to provide an adapter for converting a single valve flush system into a dual valve flush system incorporating the conventional single valve system.

It is another object of the invention to provide an adapter that is easily attachable to the existing single flush system and to the flush tank for the toilet.

It is still another object of the invention to provide an adapter that has a simple construction and is inexpensive to manufacture.

It is still a further object of the present invention to provide an adapter which can be configured for mounting to either a side wall or a front wall of the flush tank to accommodate various configurations for the particular single valve system located within the tank.

The present invention is an adapter for a single valve flush system utilized to convert the single valve system into a dual mode valve system. The adapter includes a first tubular section having an open upper end securable to the bottom of the single valve system and a closed lower end, and a second tubular section having an open upper end and an open lower end attachable to the flush tank. The second tubular may conveniently comprise one type of existing flapper valve commonly used. The first section and second section are connected by a hollow channel extending between the lower end of the first section and the upper end of the second section such that the upper end of the second section is generally at the same height as the lower end of the first section.

The adapter also includes a flapper valve pivotally mounted to the first section and releasably engageable with the upper end of the second section to selectively open and close the upper end of the second section.

When the adapter and the single valve system are secured to one another and to the flush tank, the flapper valves are operated by a pair of handles located on the exterior of the tank and attached to a mounting assembly. The mounting assembly includes a sleeve extending through a wall of the flush tank and enclosing a pair of cylindrical arms that are rotatably contained within a pair of throughbores extending through the sleeve. Opposite the handles, the arms are connected to a pair of levers which are in turn connected to a pair of chains which lead down to the flapper valves. By moving one or the other of the handles, the selected valve can be opened in order to flush the toilet with the desired volume of water.

Various other features, objects and advantages of the invention will be made apparent from the following detailed description taken together with the drawings.

BRIEF DESCRIPTION OF THE DRAWINGS

The following drawings illustrate the best mode currently contemplated of practicing the present invention.

FIG. 1 is a side elevation view of a toilet tank enclosing a single valve flush system connected to an adapter constructed according to the present invention to form a dual valve flush system;

FIG. 2 is an enlarged partial sectional view through the toilet tank of FIG. 1 showing the dual valve flush system.

FIG. 5 is a partial horizontal section through a toilet tank showing a mounting assembly and handles secured to a wall of the toilet tank for connection to the dual valve flush system of FIG. 2;

FIG. 6 is an enlarged partial sectional view of the handles and mounting assembly of FIG. 5;

FIG. 7 is a sectional view taken on line 7—7 of FIG. 6;

FIG. 7A is a sectional view taken on line 7A—7A of FIG. 6;

DETAILED DESCRIPTION OF THE INVENTION

Figure 3:
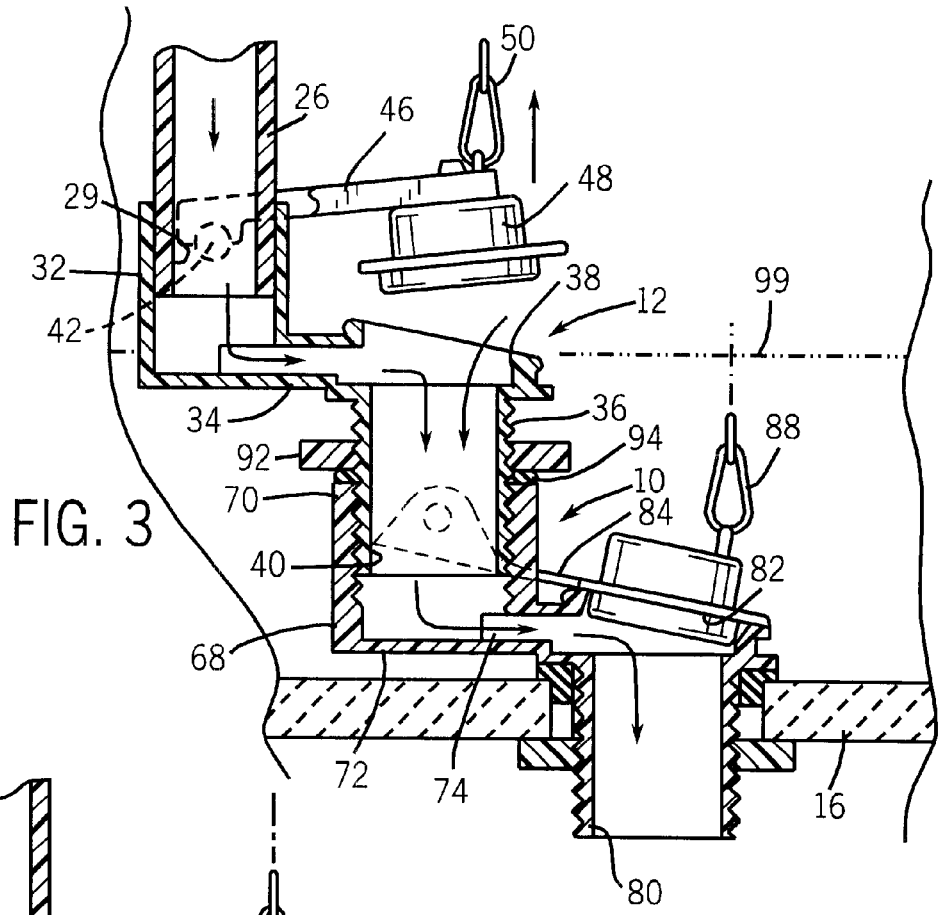
FIG. 3 is a vertical sectional view of the flush system of FIG. 2 with the low volume flapper valve opened.

With respect now to the drawing figures in which like reference numerals designate like parts throughout the disclosure, in FIG. 1 a flush system adapter 10 is illustrated schematically and shown connected to a single valve system 12 within a toilet flush tank 14 to provide the present invention. Referring also to FIG. 2, the tank 14 includes a bottom wall 16 which defines a discharge opening 18, a front wall 20, a rear wall 22 and a pair of side walls 23 joining front and rear walls 20 and 22, respectively, to form an open top 24 that is closed by a removable cover 25, all in a conventional manner.

Figure 4:
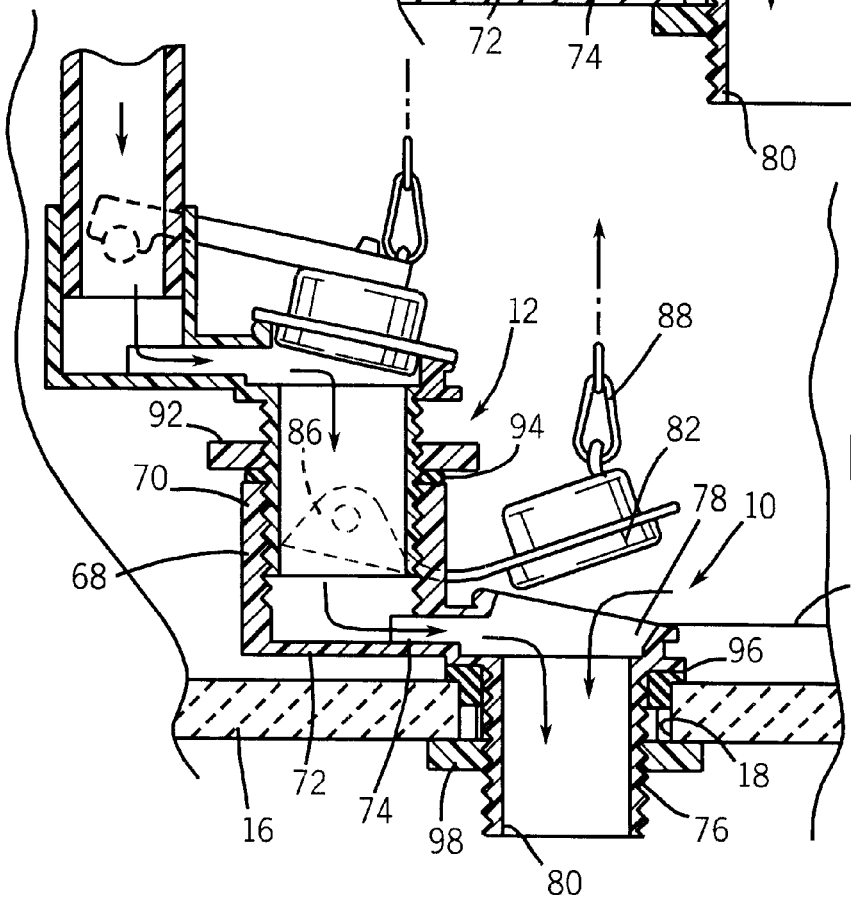
FIG. 4 is a vertical sectional view of the flush system of FIG. 2 with the high volume flapper valve opened.

Referring also to FIGS. 3, and 4, the single valve system 12 can be any conventional flush system used for single flush toilets but preferably is the system made by Fluid Master, Inc. of San Juan Capastrano, calif. The system 12 includes an upper tubular section comprising an upwardly extending stand pipe 26 having an open upper end 28 and connected at a lower end 29 to an L-shaped tube 30. The tube 30 includes a sleeve 32 into which the lower end 29 of the stand pipe 26 is inserted. The sleeve 32 is in fluid communication with an passage 34 which extends perpendicularly from the sleeve 32 to a lower tubular section including a discharge pipe 36. The discharge pipe 36 is generally circular in shape and includes a sloped, open upper end 38, and an open lower end 40. The upper end 38 is connected to the passage 34 such that fluid flowing down the stand pipe 26 into the sleeve 32 will flow through the passage 34 and into the discharge pipe 36.

The sleeve 32 also includes a pair of outwardly extending projections 42 spaced on opposite sides of the sleeve 32. The projections 42 are each connected to a pair of flanges 44 extending from opposite sides of a valve support 46. The valve support 46 is connected to a first flapper valve 48 that is capable of moving pivotally with the valve support 46. With the pivoting movement, the valve 48 is releasably engageable with the sloped open upper end 38 of the discharge pipe 36. This enables the discharge pipe 36 to be selectively opened and closed by the movement of the flapper valve 48.

Referring now to FIGS. 5–7, a chain 50 is connected at one end to the flapper valve 48 and at the opposite end to a first lever 52. The first lever 52 is in turn connected opposite the chain 50 to a mounting assembly 54. The mounting assembly 54 includes a generally cylindrical sleeve 56 disposed in a wall 23 of the flush tank 14. The sleeve 56 has a pair of parallel throughbores 58 which extend the length of the sleeve. Each throughbore 58 encloses a rotatable cylindrical arm 60 and 61, respectively, which has its opposed ends positioned on opposite sides of the tank wall 23. The arms 60 are connected outside of the tank 14 to a pair of handles 62 and 63 each of which terminates in a finger grip 64 opposite the arms 60 and 61.

On the exterior of the flush tank wall, the end of cylindrical sleeve 56 also includes a mounting flange 66 that retains the outer ends of the rotatable arms 60 and 61 and cooperates with a mounting collar 67 threaded on the threaded OD 69 of the sleeve 56 inside the tank wall to hold the entire assembly in place. The opposite ends of the rotatable arms 60 and 61 are retained in place axially with an end cap 71 threaded over the end of the sleeve 56. More specifically and referring also to FIG. 7A, before the end cap 71 is threaded over the end of the sleeve 56, a retainer insert 103 is first placed over the ends of the rotatable arms 60 and 61 and against the end of the cylindrical sleeve 56. Preferably, the retainer insert is provided with two openings 106 sized to receive the ends of the arms 60 and 61 and also includes a pair of diametrically opposite retaining tabs 105. The retainer insert 103 is received in a shallow circular recess 104 formed in the end of the cylindrical sleeve 56. The rim 108 defining the end recess 104 is provided with a pair of notches 107 that receive the retaining tabs 105 when the insert is positioned in the recess 104. The end cap 71 has a central opening 109 large enough in diameter to receive both extended arms 60 and 61 so it may be threaded onto the end of the sleeve 56 to hold the insert 103 in place.

Looking again at FIGS. 2–4, the adapter 10 includes an upper tubular section 68 having an open upper end 70 and a closed lower end 72. Adjacent the lower end 72, an enclosed channel 74 extends outwardly from the first tubular section 68 and is connected to a lower tubular section 76. The lower tubular section 76 includes a sloped open upper end 78, to which the channel 74 is connected, and an open lower end 80. The lower end 80 connects to the toilet stool inlet in a conventional manner. The upper section 68, channel 74 and lower section 76 are all formed of a rigid, durable material, such as a hard plastic, preferably the same material as the upper valve system 12, and are connected by any suitable means. Each of the lower section 68, upper section 76 and channel 74 may be formed of PVC and secured to the remaining parts by an adhesive.

The adapter 10 also includes a second flapper valve 82 having a pair of extensions 84 extending outwardly from opposite sides of the second valve 82 parallel to one another. The extensions 84 are pivotally mounted to opposite sides of the upper section 68 by a pair of projections 86. The second valve 82 further includes a chain 88 attached to the second valve 82 at one end and to a second lever 90 at the other end (see FIG. 5). The second lever 90 is attached to the cylindrical arm 61 adjacent the arm 60 to which the first lever 52 is attached.

To secure the single valve system 12 to the adapter 10, a threaded collar 92 is threadably engaged with the lower end 40 of the discharge pipe 36. A first 0-ring 94 is then positioned around the lower end 40 beneath the washer 92. The lower end 40 is then threadedly engaged within the open upper end 70 of the upper section 68 until the flush system 12 is positioned at a desired height above the adapter 10. The collar 92 is then rotated with respect to the discharge pipe 36 until the washer 92 compresses the 0-ring 94 into engagement with the upper end 70 of the upper tubular section 68. In this manner, the O-ring 94 forms a water-tight barrier between the discharge pipe 36 and upper tubular section 68.

Once the single valve system 12 is attached to the adapter 10, the adapter 10 can be secured to the flush tank 14. A sealing ring 96 is positioned around the open lower end 80 of the lower tubular section 76 and the section 76 is inserted through the discharge opening 18 in the bottom wall 16 of the flush tank 14. A second collar 98 is then threadedly engaged with the lower end 80 beneath the bottom wall 16 of the flush tank 14. The collar 98 is then rotated with respect to the lower section 76 in order to compress the sealing ring 96 between the bottom wall 16 of the tank 14 and the lower end 80 of the lower section 76 to form a watertight seal between the lower section 76 and the bottom wall 16 of tank 14.

Referring now to FIGS. 1, 3 and 5, once the adapter 10 and single valve system 12 are secured to one another and to the flush tank 14, the handles 62 and 63 can be utilized to operate either the first valve 48 on the system 12 or the second valve 82 on the adapter 10 to provide the desired amount of water for flushing the toilet. As shown in FIGS. 3 and 5, when the handle 62 is pivoted with respect to the flush tank 14, the attached cylindrical arm 60 rotates and first lever 52 moves upwardly to unseat the first valve 48 from within the open upper end 38 of the discharge pipe 36. Movement of the first valve 48 causes the volume of water contained between the full water level at the top of the standpipe 26 for the flush tank 14 and a water level 99 at the bottommost portion of the open upper end 38 to flow through the discharge pipe 36 and provide a flushing action for the toilet.

Figure 8:
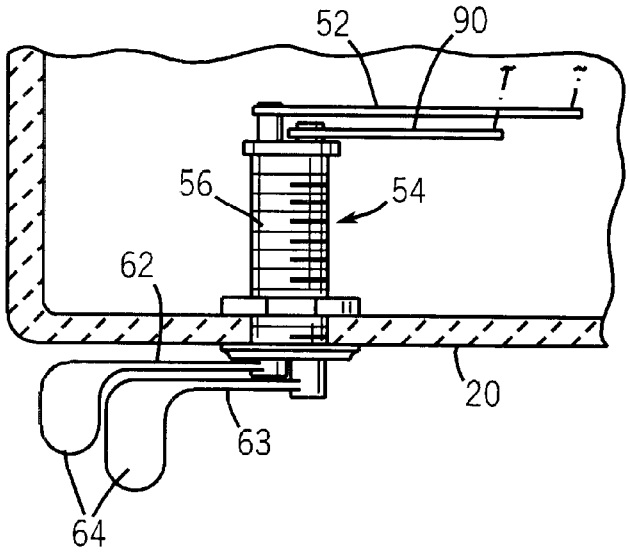
FIG. 8 is a view similar to FIG. 5 showing the handle mounting assembly attached to the opposite side of a tank front wall; and, FIG. 9 is a horizontal section through a toilet tank showing a handle mounting assembly with extended operating arms for mounting to a tank side wall.

Alternatively and referring also to FIG. 4, when the handle 63 is pivoted with respect to the flush tank 14, the attached cylindrical arm 61 and second lever 90 operate to lift the second valve 82 from within the upper end 78 of the lower tubular section 76. Unseating of the second valve 82 allows the volume of water contained between the full water level for the flush tank 14 and a water level 101 at the bottommost portion of the upper end 78 to flow through the lower section 76 and provide a flushing action for the toilet. FIG. 8 shows how the operating handle mounting assembly 54 is easily adapted for opposite mounting on the other end of the tank front wall 20 from the FIG. 5 mounting.

Figure 9:
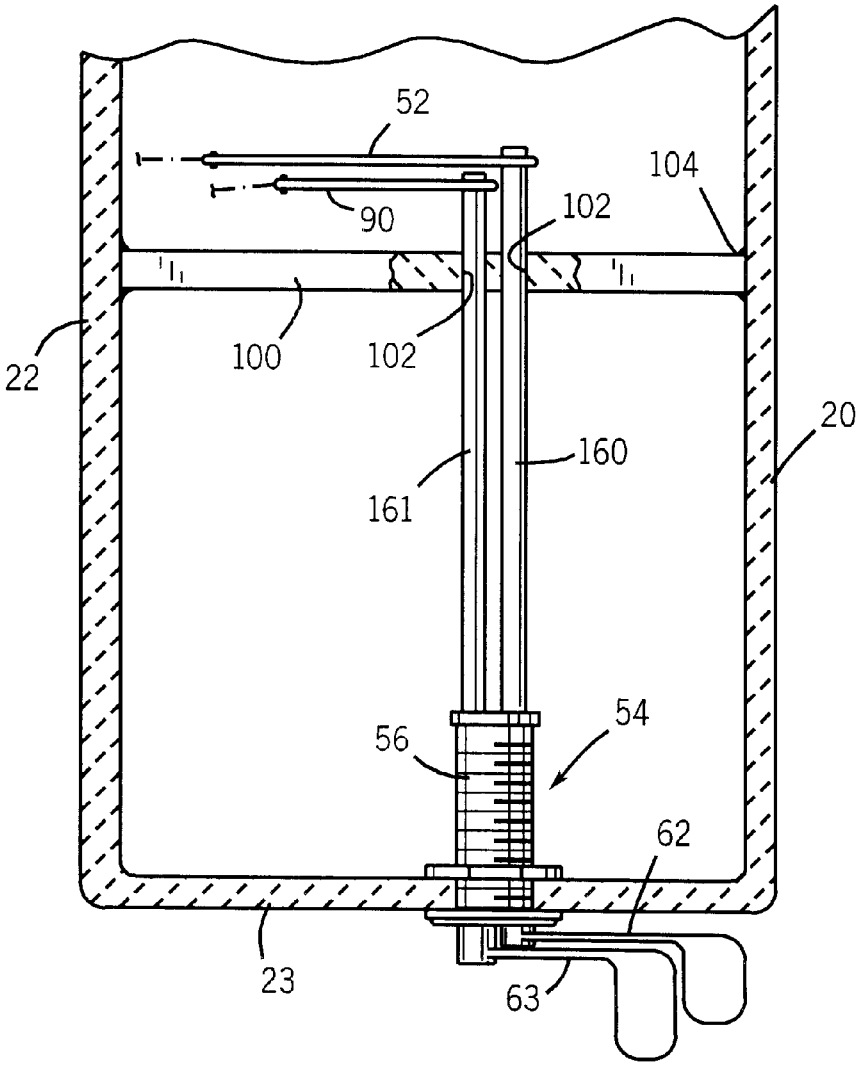

In an alternative embodiment, as best shown in FIG. 9, the handles 62 and 63 can also be mounted on a side wall 23 of the flush tank 14. In this embodiment, each of the rotatable arms 160 and 161 extending outwardly from the throughbores 58 in the sleeve 56 has a length greater than the arms 60 and 61 utilized when the mounting assembly 54 is disposed on the front wall 20 of the tank 14. In this embodiment, the arms 160 and 161 are supported opposite the side wall 22 by a support 100 extending across the tank 14 between the front wall 20 and rear wall 22. The arms 160 and 161 extend through a pair of adjacent openings 102 disposed in the support 100 and in alignment with the throughbores 58 in the sleeve 56. The openings 102 have a diameter slightly larger than the diameter of the arms 160 and 161 such that the arms may rotate easily within each of the openings 102. Further, the arms 160 and 161 are attached to the chains 50 and 88 secured to the first and second valves 48 and 82, respectively, on the side of the support 100 opposite the mounting assembly 54. All of the other components of the mounting assembly are identical to the previously described embodiment.

The support 100 can be positioned between the front wall 20 and rear wall 22 of the tank 14 by any suitable means, such as an adhesive 104, as shown in FIG. 9, or by other suitable means, such as by U-shaped hanger brackets, not shown, attached at opposite ends of the support 100 and engageable with the top edges of the front wall 20 and rear wall 22.

Various alternatives are contemplated as being within the scope of the following claims particularly pointing out and distinctly claiming the subject matter regarded as the invention.

We claim:

1. In a toilet flush tank including a discharge valve having an externally threaded first lower tubular section mounted in a tank outlet in a tank bottom wall and secured therein with a collar threaded onto the first lower tubular section outside the bottom wall, a first flapper valve mounted to selectively open an upper end of the first lower tubular section immediately above the tank bottom wall and aligned axially with the tank outlet for discharge of substantially all water in the tank, a first upper tubular section offset laterally with respect to and having a lower end in fluid communication with the upper end of the first lower tubular section and an open upper end having secured therein a lower end of an upwardly extending standpipe, a dual level flush adapter insertable between the discharge valve and the tank outlet after removal of said discharge valve, said adapter comprising:

an externally threaded second lower tubular section having a construction identical to said first lower tubular section, mounted in the tank outlet and secured therein with the collar in place of the first lower tubular section of said discharge valve and to provide for discharge of substantially all water in the tank, a second flapper valve mounted to selectively open an upper end of the second lower tubular section immediately above the tank bottom wall and aligned axially with the tank outlet in direct functional and positional replacement of said first lower tubular section and first flapper valve;

a second upper tubular section offset laterally with respect to and having a lower end in fluid communication with the upper end of said second lower tubular section and an internally threaded open upper end sized to receive the externally threaded first lower tubular section of said discharge valve to position said first flapper valve at a selected level above said second flapper valve, whereby the volume of water discharged through said first flapper valve is adjustable.

2. The apparatus as set forth in claim 1 including a locking collar threaded on the first lower tubular section above the upper end of said second upper tubular section and operatively engageable therewith to establish said selected level.

3. The apparatus as set forth in claim 2 including an annular seal surrounding said first lower tubular section between the locking collar and the upper end of said second upper tubular section.

* * * * *